US006361048B1

(12) United States Patent
Lynn

(10) Patent No.: US 6,361,048 B1
(45) Date of Patent: Mar. 26, 2002

(54) GAME BOARD APPARATUS AND METHOD OF PLAYING SAME

(76) Inventor: James Lynn, 819½ N. Garfield St., Santa Ana, CA (US) 92701

( * ) Notice: Subject to any disclaimer, the term of this patent is extended or adjusted under 35 U.S.C. 154(b) by 0 days.

(21) Appl. No.: 09/752,164

(22) Filed: Dec. 29, 2000

(51) Int. Cl.[7] ..... A63F 3/00

(52) U.S. Cl. ..... 273/280; 273/287; 273/243; 273/253; 273/284; 273/283

(58) Field of Search ..... 273/280, 243, 273/283, 287, 250–254, 284

(56) References Cited

U.S. PATENT DOCUMENTS 3,172,666 A * 3/1965 Ryan
3,606,334 A * 9/1971 Pippin
3,762,714 A 10/1973 Wilson
3,804,416 A * 4/1974 Jones et al.
3,843,131 A * 10/1974 Stubbmann
3,948,527 A * 4/1976 Aguirregomezcorta
5,201,524 A * 4/1993 Csanady et al.
5,692,753 A 12/1997 Faulk
6,247,696 B1 * 6/2001 Lackender

* cited by examiner

*Primary Examiner*—Benjamin H. Layno
*Assistant Examiner*—V K Mendiratta
(74) *Attorney, Agent, or Firm*—Fulwider Patton Lee & Utecht, LLP

(57) ABSTRACT

A game board requiring strategy and providing the element of chance includes a playing surface having a fixed path section and a path altering section providing a route from at least one area to at least one finishing area and including a plurality of game piece positions along route determining placement of a number of game pieces. The playing surface overlies a king section having at least one actuator for moving the path altering section to a determined position based upon the outcome of a random number generator. A method for playing a game using the game board is also described herein.

20 Claims, 5 Drawing Sheets

GAME BOARD APPARATUS AND METHOD OF PLAYING SAME

BACKGROUND OF THE INVENTION

1. Field of the Invention

The invention relates generally to recreational gaming and more specifically to games of skill and chance requiring a number of pieces to be moved across a playing surface from one area to another area.

2. Description of the Prior Art

Games have been developed over the centuries to both entertain and to challenge. In many conventional forms of entertainment, a game board is provided that includes a fixed playing surface. Thus, game variations are provided solely by individual player movements decided by individual strategy and reactions to an opponent's moves. Games such as chess, checkers, and backgammon exhibit such characteristics. Such games typically provide different goals such as capturing certain pieces or moving a player's pieces from one portion of the board to another but the game board remains the same.

Another game requiring a player to move playing pieces from one side of a game board to another is Chinese Checkers. In Chinese Checkers, at least two players initially load several playing pieces across from their respective home positions in a starting arrangement. The game play involves players taking turns moving their pieces across a gaming surface full of discrete indentations one at a time. Upon being positioned immediately adjacent to another playing piece, the player whose turn it is, may execute a "jump" over the adjacent game piece effectively moving more than one space at a time. By planning a strategic route a player may move the game pieces across the gaming surface to the home position faster than the opponent and thus win the game.

While a number of different strategies may be introduced, this game board and most conventional game boards present the same playing surface every time the game is played. Variations of play are solely provided by the different movements executed by the players. Thus players having better memory for winning strategies, moves, or combinations or of greater experience tend to win more often thereby frustrating less experienced players. The popularity of a game often depends on the number of variations introduced thereby avoiding undesired repetition. Thus the lack of a variable gaming surface reduces the number of variations that may be encountered during play and directly affects a game's popularity.

One game attempting to provide some variation in the gaming surface may be found in U.S. Pat. No. 3,762,714 to Wilson. The marble game described therein includes a rectangular game board with a single central turntable having a number of marble retaining slots and a positional indicator. Players move around the periphery of the game board and may jump onto the turntable upon reaching a "step up" position. Once on the turntable, players position the turntable according the number rolled on a die and also move their respective player marble the same number of pieces. Players endeavor to move all their marbles around the board and/or turntable from a start position to a home area.

One drawback of such a game is that players are restricted to moving along the periphery of the turntable and the incorporation of only one turntable provides limited variability of game play. In addition, there are a limited number of positions to jump onto the turntable and thus a player may never use the turntable if the correct number is not rolled. Such restrictions introduce limited play variation.

What is needed therefore is a game inexpensive to manufacture and including a playing surface having a variety of pathways providing obstacles to player's movements and further providing countless variations of game play as well as adding an element of chance effecting each player's strategy.

SUMMARY OF THE INVENTION

In accordance with an embodiment of the present invention, a game board apparatus providing a game of strategy and chance includes a game board with a playing surface having a fixed path section, a path altering section, and a plurality of discrete game piece positions spaced between a plurality of starting and finishing areas providing a variety of pathways across the playing surface. A working section includes an actuator underlying the playing surface and connected to the path altering section to change the orientation of the path altering section as determined by a random number generator. Sets of game pieces are provided for each player and are initially positioned in the starting areas. Players take turns actuating the actuator to alter the orientation of the path altering sections and moving game pieces from their respective starting positions across the fixed and path altering sections to their respective finishing positions. Play continues until one player moves all respective game pieces into the finishing area.

In one embodiment, the path altering section is in the form of a plurality of rotating discs connected to an underlying set of gears that rotate when the actuator is rotated corresponding with an indicia indicated by the random number generator.

Another feature of the game board apparatus is the provision of blocking routes whereby movement of game piece may be prohibited along certain portions of the path sections.

A method of playing a game incorporating a game board with a variable path section is also described herein and in one embodiment includes a method for initially aligning removable path altering sections.

Numerous advantages and aspects of the invention will be apparent to those skilled in the art upon consideration of the following detailed description and attached drawing figures referenced therein.

DETAILED DESCRIPTION OF THE PREFERRED EMBODIMENTS

Figure 1:
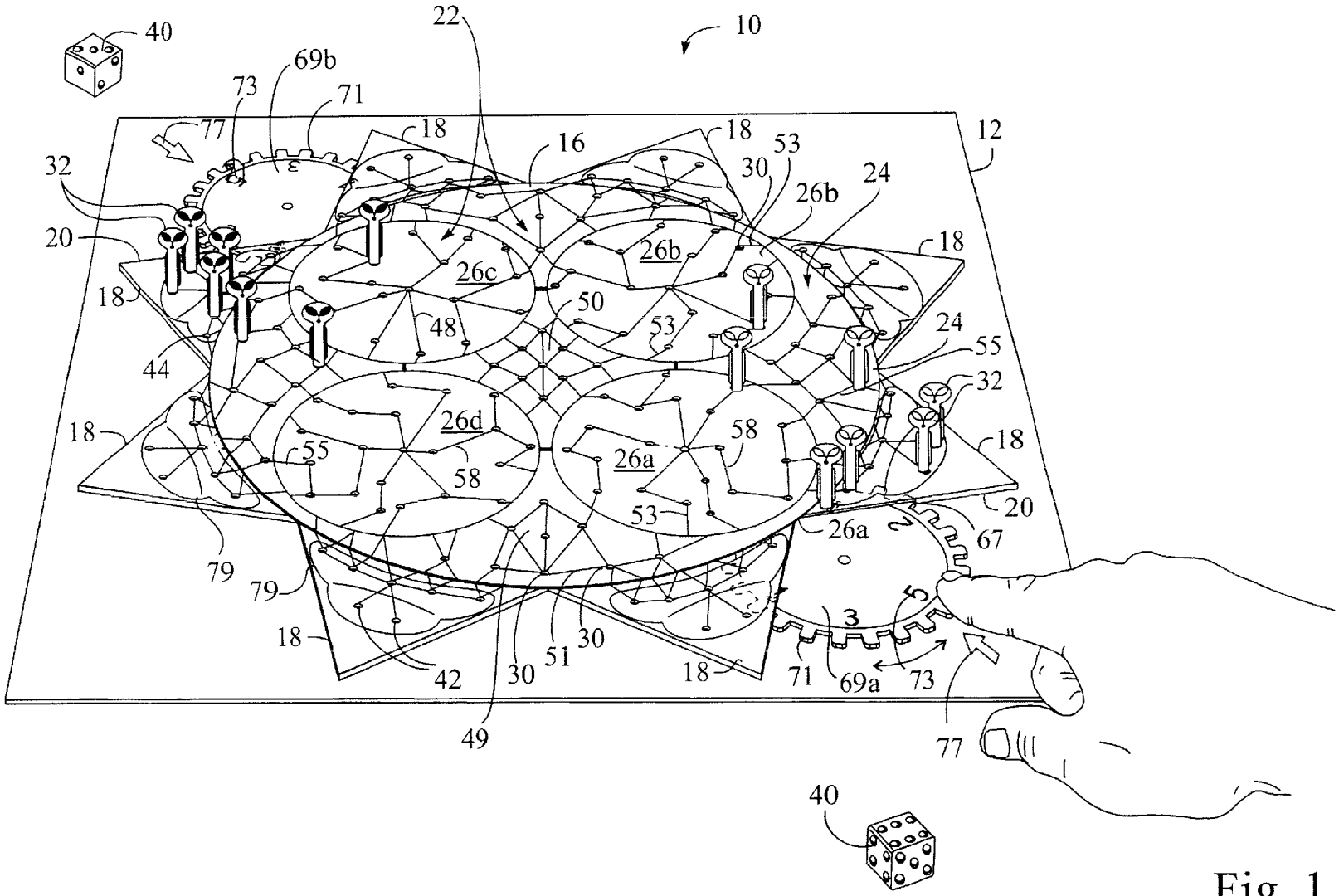
FIG. 1 is an perspective view of an embodiment of the present invention illustrating the playing surface near the beginning of an exemplary game.
Figure 2:
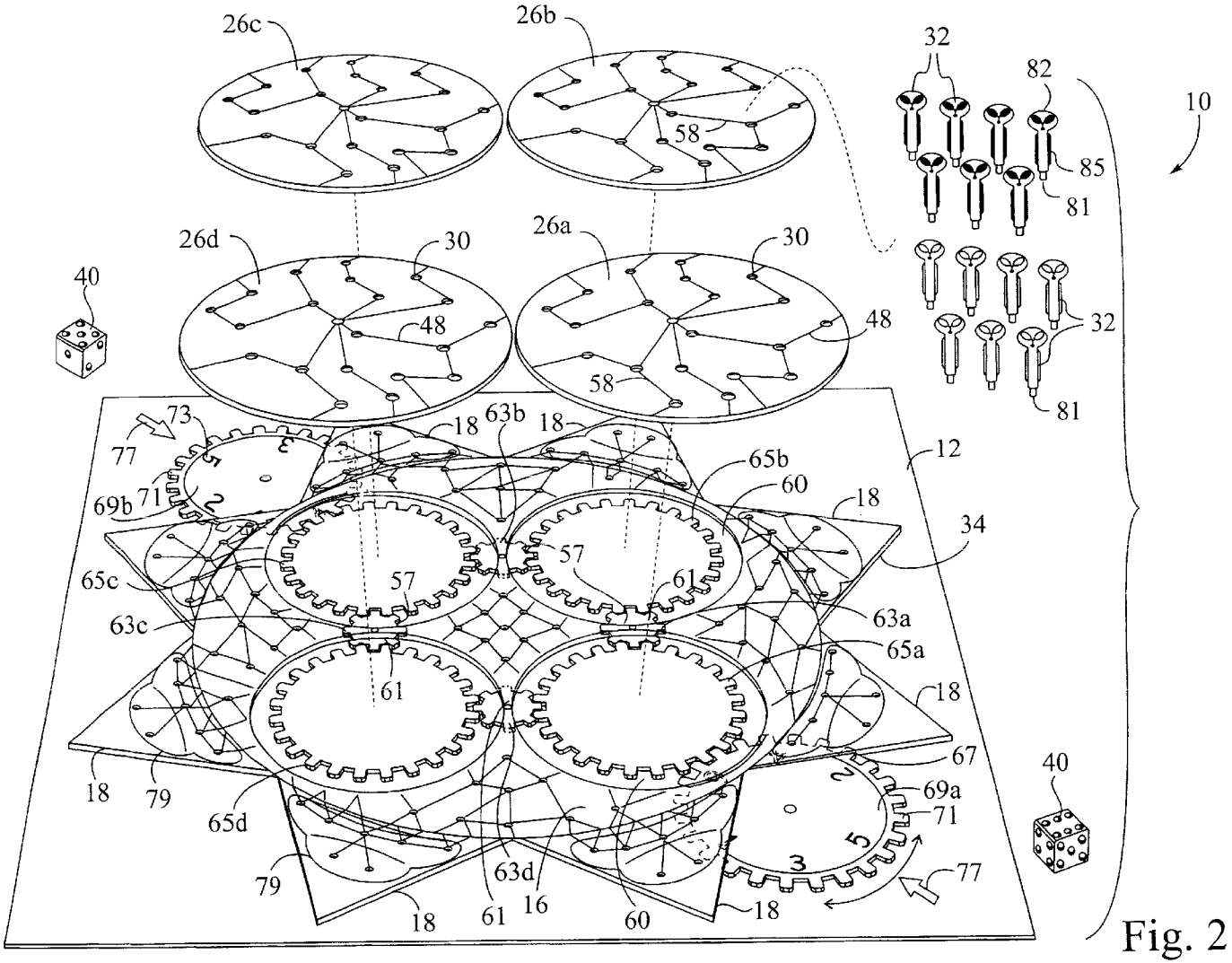
FIG. 2 is a perspective exploded view, in enlarged scale, of the embodiment illustrated in FIG. 1.

Referring now to FIGS. 1 and 2, an entertaining multiplayer game, generally designated providing the elements of skill and chance is illustrated. Such game 10 generally includes a game board 12 having an upper portion forming a playing surface 16 incorporating eight starting areas 18 which also correspond to eight finishing areas 20 marginally positioned around a central path network 22. Such central path network 22 includes a fixed path section 24 and a plurality of path altering sections 26*a*, 26*b*, 26*c*, and 26*d*. Both the fixed path section 24 and the path altering sections 26*a*, 26*b*, 26*c*, and 26*d* include a number of discrete game piece positions 30. The playing surface 16 overlies a working layer, generally designated 34, which includes at least one actuator 38 for rotationally displacing each of the rotating discs 26*a–d* as determined by a random number generator 40. Each player receives a set of game pieces 32 to move across the path network 22 in selected game piece positions 30 from each player's starting area 18 to their respective finishing area 20 to eventually win the game.

With reference to FIGS. 1 and 2, the game board 12 is preferably a layer of cardboard, plastic, lightweight aluminum or other suitable material and includes an aesthetically pleasing background on the playing surface 16. Within the playing surface 16 are eight substantially triangular shaped starting areas 18 which also form eight finishing areas 20 positioned around the circumference of the inner circular path network 22 such that each player's starting area 18 is positioned directly across their respective finishing area 20. In other words, one player's starting area may be another player's finishing area. Each such finishing area 20 includes a spaceship indicia 79 color coded to or otherwise identified with a set of game pieces 32 to indicate to the player the final destination for each game piece 32. With reference to the center of the inner path network 22, the apex of each starting area 18 and finishing area 20 is positioned 45 degrees apart around the margin of the inner path network 22. Each starting area 18 and finishing area 20 is identically shaped and includes a group of seven starting positions 42 which equate to seven finishing positions 44 for another player. One starting position 42 and finishing position 44 is provided for each game piece 22 per player.

With continued reference to FIGS. 1 and 2, positioned between starting areas 18 and finishing areas 20 is the path network 22. The path network 22 is a central circular region that provides a pathway or network of unevenly spaced game piece positions 30 within the fixed section 24 and the path altering sections 26*a*, 26*b*, 26*c*, and 26*d*. Each game piece position 30 includes a recess or slot for receipt of a complementary portion 81 of a game piece 32 and further includes a path line 48 projecting along at least one direction.

The fixed path section 24 includes a marginal fixed path area 49 and a central fixed path section 50 separated by the path altering sections 26*a–d*. These fixed sections 49 and 50 do not vary during the gameplay and provide stationary fixed path lines 48 and game piece positions 30 to direct players across the board by indicating allowable moves. The marginal section 49 of the fixed path section 24 links the starting areas 18 and finishing areas 20 to the path altering sections 26*a*, 26*b*, 26*c*, and 26*d* via path lines 48. The central section 50 links the path altering sections 26*a*, 26*b*, 26*c*, and 26*d* together via its respective path lines 48.

The path lines 48 indicate allowable directional movements for the game pieces 32 and may take several forms. For example, a path line 48 may connect two adjacent game piece positions 30 as indicated at 51 in FIG. 1. In other instances a path line 48 may project from a game piece position 30 to the edge of a path altering section 26*b* or edge of the fixed path section 24 without connecting to another game piece position 30. Such a path line 48 is indicated at 53 in FIG. 1. This type of path line 48 is a dead end and restricts a player from moving a game piece 32 in that direction to another game piece position 30 along the disconnected path line 48. In other words, a player may only move from one game piece position to another if the respective game piece positions 30 are connected by a path line. A notable exception is the jump line 45 which is discussed below. Yet another example of a path line 48 is indicated at 55 in FIG. 1. This path line 55 connects a game piece position 30 on a path altering section 26*a* to a game piece position 30 in the fixed section 24 or vice-versa. This path line 55 is not straight but may be used for movement purposes is desired. If desired, the game rules may also restrict movement only along straight path lines such as the path line 48 indicated at 58 in FIG. 1.

Advantageously, the path altering sections 26*a–d* provide variability to the game board playing surface 16 by being constructed in the form of rotating discs. By rotating the discs 26*a–d* to match different path lines 48 in the fixed sections 49 and 50 or match the jump line 45, movement options by each player are varied with each turn as their game pieces 32 are advanced across the playing surface 16 and moved into position to move onto or off of any of the path altering sections 26*a–d*. It will be appreciated that in the present configuration a player must move game pieces 32 onto the path altering sections 26*a–d* and thus the element of chance and a greater degree of strategy is introduced into the game play. Each path altering section 26*a–d* includes a central hub 52 to preferably five or six path lines which radiate in a generally outwardly direction from the central hub 52 to the edge of the respective path altering section 26*a–d*. Game piece positions 30 are unevenly spaced over each path altering section 26*a–d* and path lines 48 connect the game piece positions as well as extend to the edge of the discs 26*a–d*. In other words, each path altering section 26*a–d* is constructed to rotate such that the path lines 48 thereon projecting to the edge may be matched up against path lines 48 in the fixed section 24 or line up with a jump line 45 which connects one path altering section to another. Thus alternate routes are formed every time the path altering sections 26*a–d* are rotated. Each disc 26*a–d* may incorporate an identical or dissimilar pattern as desired.

Referring now to FIG. 2, rotation of the path altering sections 26*a*, 26*b*, 26*c*, and 26*d* is provided by a gearing system, generally designated 59, disposed within the working section 34. The gearing system 59 includes four large gear cavities 60 recessed into the game board 12 and separated by narrow strips 61 of the playing surface 16. The gearing system 59 includes a number of small gear clearance passages underneath each of the narrow strips 61 for receipt of a small gear 63*a*, 63*b*, 63*c*, and 63*d*. Each small gear 63 is placed between a pair of adjacent large gears 65*a*, 65*b*, 65*c*, and 65*d* placed within the large gear cavities 60. Each large gear 65*a–d* is disposed within the working section 34 positioned beneath a path altering section 26*a*, 26*b*, 26*c*, and 26*d*. The path altering sections 26*a–d* are preferably removable such that discs bearing alternative path designs or different aesthetic backgrounds may be substituted into the game board 12. The discs 26*a–d* may be releasably adhered to the large gears 65*a–d* magnetically, by a releasable adhesive, mechanically locked together such as provided by a conventional hook and loop type fastener or other releasable fastener known in the art such that when the respective large gear 65*a–d* rotates, the respective path altering section 26*a–d* rotates along with the large gear but the discs 26*a–d* may be released and removed from the game board 12 if desired. The discs 26*a–d* cover their respective large gear cavities 60 and extend to abut the fixed path section 24 on the playing surface 16 when releasably connected to the large gears 65*a–d*.

With continued reference to FIG. 2, actuator slots 67 are formed in the opposing sides of the working section 34 to receive opposing actuators 69*a* and 69*b* which are also gears including a peripheral toothed ridge 71 to facilitate turning and intermeshing with the teeth of the large gears 65*a–d*. The upper surface of each actuator 69*a*, 69*b* is marked with numerical indicators 73 corresponding to the sides of the die 40. The small gears 63*a–d*, large gears 65*a–d* and actuators 69 lie in the same plane and are arranged in an intermeshing relationship such that turning either actuator 69*a* or 69*b* will rotate each large gear 65*a–d* either directly or indirectly via a large gear-small gear interconnection. Such actuators 69*a*, 69*b* rotate in either the clockwise or counterclockwise directions. Due to the incorporation of the small intermediate gears 63*a–d*, rotation of either actuator 69*a* or 69*b* rotates the large gears in the same direction but opposite to the actuator rotation. Omission of the small gears results in two of the large gears turning in the same direction as the actuator and the remaining two large gears turning in the opposite direction as the actuator.

Determining the degree of rotation of the actuators 69*a*, 69*b* during game play is a random number generator 40. The random number generator 40 is preferably a 6-sided die which is rolled to provide a randomly generated number as indicated by the die's uppermost surface. The uppermost number determines to which position the actuator 69*a* or 69*b* nearest the rolling player is rotated during the player's turn. A pair of actuator position indicators 77 in the form of a line or arrow is provided on the playing surface 16 to correspond to a position on the nearest actuator 69*a*, 69*b*. Such position indicators 77 provide a location to line up the outermost actuator marking 73 during rotation of the actuators 69*a*, 69*b* to correspond with the uppermost number on the die 40.

The game pieces 32 are typically formed of a plastic material and shaped in any aesthetically pleasing form. For exemplary purposes, two sets of game pieces are illustrated in FIG. 2. As illustrated, the game pieces includes a flared head 82 section atop a reduced in diameter cylindrical main body portion 85. This facilitates grabbing the game piece 32 to remove it from the game board 12. Each game piece 32 further includes a short cylindrical peg 81 projecting out the lowermost end of the main body. Such peg 81 is dimensioned to nest within an individual game piece position 30 recess and is of sufficient length and diameter to maintain the game piece 32 in a relatively upright position in relation to the playing surface 16.

The object of the game is to move all of a player's game pieces 32 from a starting area 18 to a respective finishing area 20 indicated by a spaceship indicia 79 having the same color or other designation as the player's game pieces 32. It is preferable to place each player's starting area 18 directly across from the finishing area 20 to provide the longest route. Players may roll the die 40 or agree to some other method for determining who goes first. The order of play for the remaining players is determined in a clockwise direction from the position of the initiating player or other agreed upon criteria.

Referring now to FIG. 1, to play the game 10, each player selects game pieces 32 corresponding to their desired finishing area 20 coded indicia. The game pieces 32 are placed in their starting positions 42 in their respective starting areas 18 directly opposite the respective finishing area 20. In FIG. 1 each player has four such game pieces 32 in their initial starting position 42. The peg 81 on each game piece 32 is inserted into a recess in an individual starting position 42 to selectively position each game piece 32 in an upright position on the game board 12 to fill in as many starting areas 18 as there are players. In general, each player takes turns moving individual game pieces 32 from the initial starting positions 42 onto a game piece position 30 in the path network 22 and across the playing surface 16 from one game piece position 30 to an adjacent game piece position connected by a path line 48. Die 40 rolls are used to change the orientation of the path altering sections 26*a–d* thus changing allowable moves along the path lines 48 which may be disconnected or connected as the discs 26*a–d* rotate. Play ends when a player positions all their game pieces 32 in their respective finishing positions 44.

Figure 3:
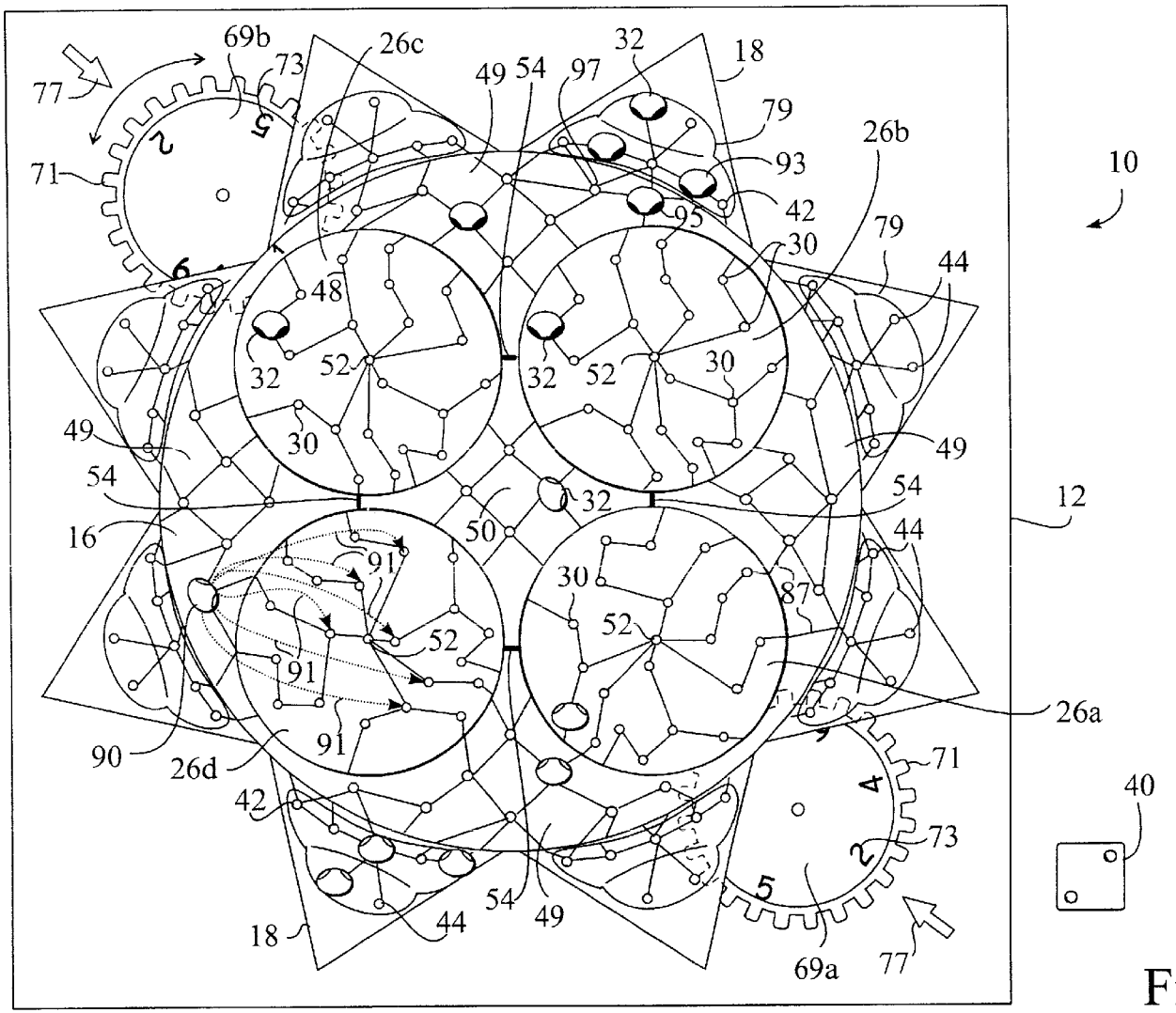
FIG. 3 is a top view of the embodiment, in enlarged scale, illustrated in FIG. 1 illustrating an intermediate position for the game and some exemplary movements of the game pieces.
Figure 4:
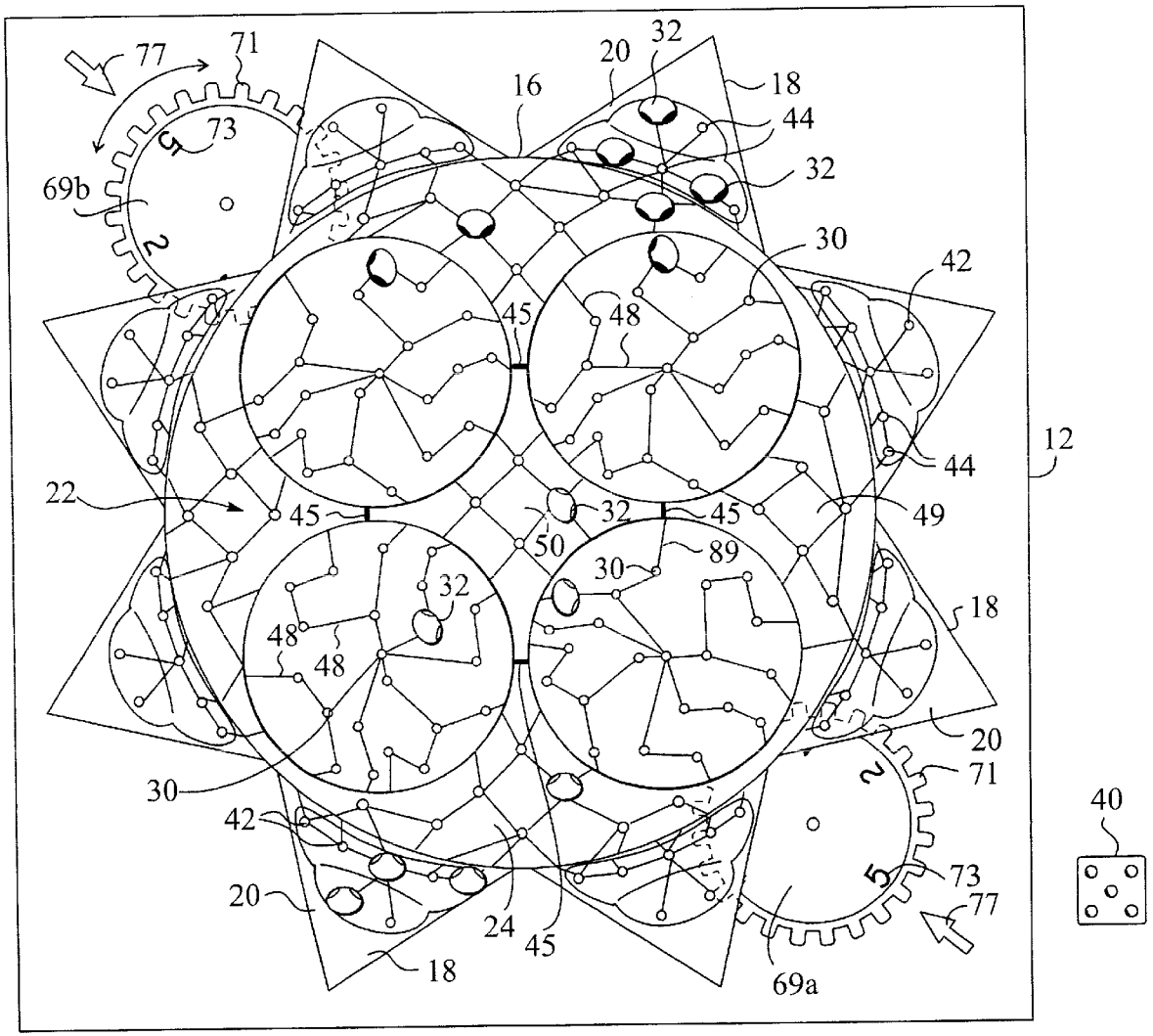
FIG. 4 is the same view as illustrated in FIG. 3 depicting a change in the path during an intermediate stage in the progression of the game.

More specifically, the first player rolls a die 40 and reads the number facing upwards on the die. The first player grasps one edge of the closest actuator 69*a* or 69*b* which is conveniently formed with a ridged surface 71 to facilitate turning of the actuator 69*a*, 69*b* until the outermost number 73 is aligned with the actuator position indicator 77 on the game board 12. For exemplary purposes, the actuator is initially positioned to match the number "2" with the actuator position indicator (FIG. 3). The player rolls a "5" and grasps the edge 71 of the actuator 69*a*, 69*b* and rotates the actuator until the actuator position indicator is aligned with "5" (FIG. 4).

Referring now to FIG. 2. rotation of the gearing system 59 is as follows. The gears 63*a–d*, 65*a–d*, and 69*a–b* are free to rotate in either direction although it will be appreciated that a one-way ratcheting system could be incorporated to restrict rotation of the actuator in a single direction. Turning, for example, the actuator 69*a* in a clockwise direction from the "2" position to the "5" position rotates the nearest large gear 65*a* in the working section 34 to turn in the opposite direction or counterclockwise. Both small gears 63*a* and 63*b* intermeshing with the large gear 65*a* rotated by the actuator 69*a* are also rotated in the clockwise direction. The clockwise rotation of the small gears 63*a* and 63*b* initiates rotation of the large gears 65*b* and 65*d* in the counterclockwise direction which in turn rotates the small gears 63*c* and 63*d* in the clockwise direction. Both small gears 63*c* and 63*d* intermesh with large gear 65*c* and drive it in a counterclockwise direction. Finally, large gear 65*c* which intermeshes with the gear teeth of actuator 69*b* and drives it in the clockwise direction. Thus, the gearing system 59 exemplified in FIG. 2 provides a gearing sequence which turns all large gears 65*a–d* in the same direction and opposite to the actuators' 69*a*, 69*b* direction of rotation. It will be appreciated that numerous other gearing systems may be incorporated without departing from the scope and spirit of the invention. For instance the small gears 63*a–d* may be removed and the large gears 65*a–d* be enlarged to intermesh. In this instance two of the gears would rotate in the same direction as the actuator and the remaining two gears would rotate in the opposite direction to the actuator rotation.

The rotation of the actuator 69*a* is continued until the actuator position indicator 77 and outermost numeral indicator 73 on the actuator 69*a* are positioned adjacent to one another. Upon reaching this alignment, the large gears 65*a–d* will have rotated to a predetermined orientation carrying their respective discs 26*a–d* and any game pieces 32 disposed thereon to a new position. As six different positions are indicated on the actuators 69*a*, 69*b* each rotation to an adjacent alignment position rotates each disc 26*a–d* about 60 degrees. In addition, rotation of the discs 26*a–d* varies the current allowable path movements by realigning the path lines 48 on the discs 26*a–d* in relation to the path lines 48 on the fixed path section 24 such that some path lines 48 are no longer aligned and other paths lines are aligned which were not previously aligned. Those path lines 48 that are not aligned form a discontinuity and prevent a player from moving along such misaligned path line 48. Referring more specifically to FIG. 3, a number of game pieces 32 are positioned on the discs 26*a–d* in specific game piece positions 30 prior to the rotation of the actuator 69. After the die 40 is rolled and a new number is generated, the actuator 69*a* or 69*b* is rotated to the align its indicia 73 corresponding to the newly generated number with the position indicator 77. In this example, the actuator is rotated from the "2" position to the "5" position, and the discs 26*a–d* and game pieces 32 thereon are rotated sixty degrees (FIG. 4). In FIG. 3 several path lines 48 on the disc 26*a* match with path lines 48 in the marginal fixed section 49 as indicated at 87. This would be an allowable move if a game piece were on either game piece position 30 connected by the path line 48. As shown in FIG. 4 after rotation of the actuator to the "5" position, these path lines 48 on disc 26*a* are no longer matched up with the fixed path section 24 path lines 48 and thus there are no allowable moves except one. As illustrated in FIG. 4, a path line indicated at 89 has connected to a jump line 45 after rotation of disc 26*a*. Thus a player having a game piece 32 in the game piece position 30 at one end of the path line 48 connected to the jump line 45 could move the game piece 32 to disc 26*b* in the hub position 52 or any adjacent game piece position 30 as the rules dictate.

Other allowable moves are as follows. Referring to FIG. 3, the game piece 32 indicated at 90 is in a game piece position 30 in the fixed path section 24 having a path line 48 connected to a path line 48 on disc 26*d*. Thus, assuming the player's turn is starting, the player could elect to move the game piece 90 to one of six game piece positions 30 adjacent to the central hub 52 of disc 26*d* as indicated by arrows 91. The player would then have to work the game piece 32 outwardly from the center section 52 and off the disc 26*d* toward the finishing area 20.

In certain situations, a player may jump a game piece 32 two spaces to a twice removed game piece position 30. This move is allowed if an intermediate game piece 32 is between a player's game piece 32 and an open game piece position and a path line 48 connects each position. For example, as illustrated in FIG. 3, the game piece indicated at 93 could leap the game piece indicated at 95 to the game piece position 30 indicated at 97.

Play continues until one player positions all their respective game pieces 32 in their respective finishing area 20 in the finishing positions 44 provided therein. If the number indicated by the die 40 is the same as is currently indicated by the actuator position indicator 77, then the actuator 69*a*, 69*b* is not moved and rotating discs 26*a–d* are maintained in their current orientation.

Figure 5:
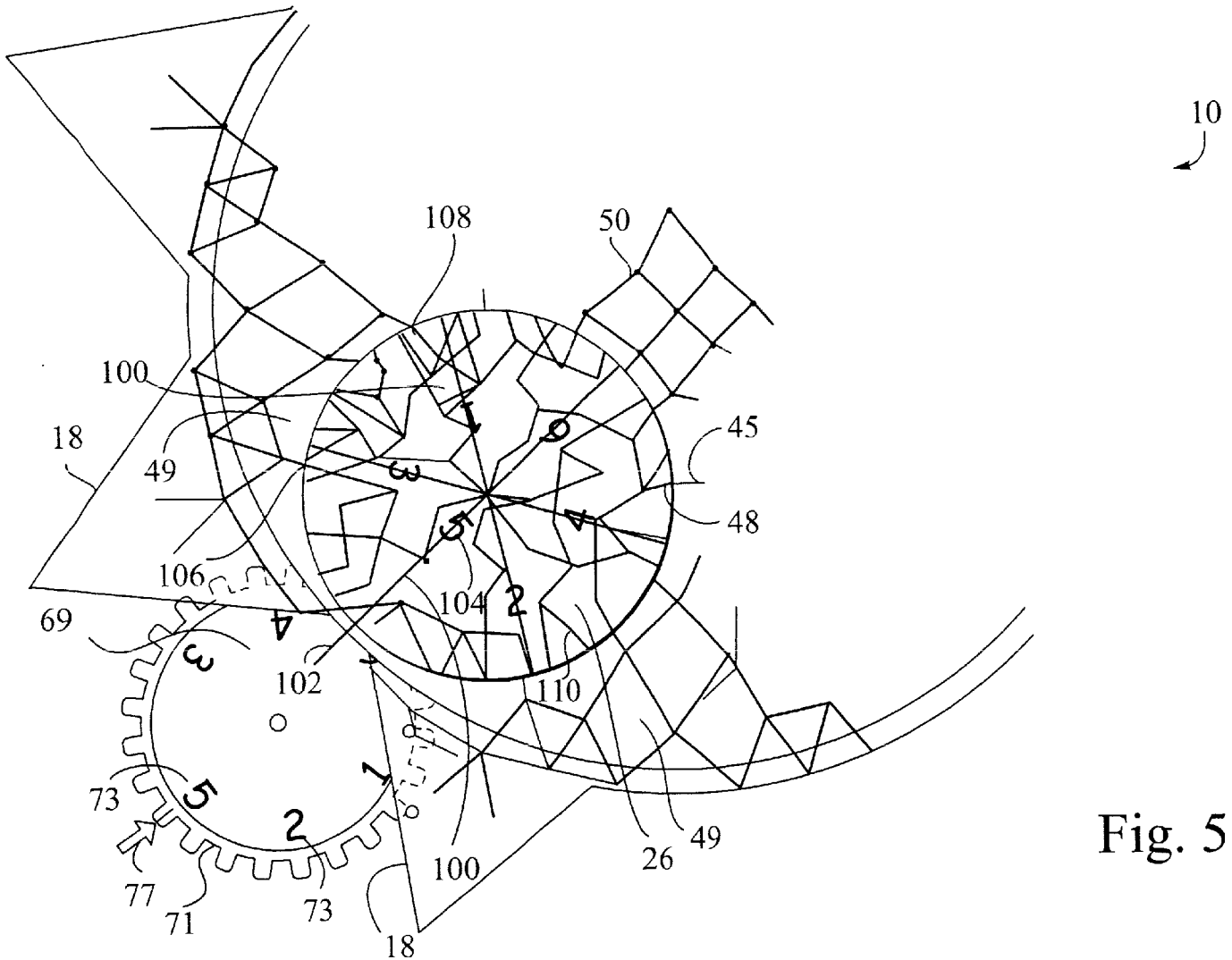
FIG. 5 is a partial view of a second embodiment of the present invention illustrating the initial placement of one of the rotating discs on the gameboard.

Referring now to FIG. 5, a second embodiment of the present invention is illustrated as section of the game board 12. For purposes of this example it will be assumed that each rotating disc 26*a–d* is identical and a preferred path pattern is depicted. It will further be understood that only a portion of the game board is depicted in FIG. 5 necessary for this explanation and that the game board itself is symmetrical about a central axes and like components are like numbered. The disc 26 is broken into six equal sectors or any number of sectors corresponding with the number of indicia 73 on the actuator 69. As the discs 26 are preferably removable and different discs may be substituted, a method for initially lining up the disc is required. A sector line 100 with a sector number 104 is lined up with an alignment indicator 102 on the game board positioned between two starting areas 18. To properly align the disc 26, the aligned sector number 104 is selected to match the outermost numerical indicator 73 on the actuator 69 surface.

A formula is used to provide the line matches and mismatches. A series of four questions is used to help develop a preferable disc path design. Each question is in reference to a sector line 100 matched with the alignment indicator 102. The first question is whether the player will have the option to jump using the jump line either left or right to another disc. In other words, haves a path line 48 on the disc 26 connect to the jump line 45 on either side of the disc 26. The right side being defined as the side of the disc toward the counterclockwise side from the sector line 100. The second question is how many path lines 48 match up on the left side and how many path lines 48 match up on the right side of the disc 26 with the marginal fixed path sections The third question is how many path lines 48 match up with the center fixed path section 50. The last part of the table provides the odds of moving off the disc 26 based on the number of available matching path lines as indicated in question two. The following table provides the results for a disc divided into six sectors:

| Sector # | Question 1 | Question 2 | Question 3 | Question 4 |
|---|---|---|---|---|
| 1 | Jump Right | 2L, 3R | M3 | Right Side |
| 2 | Jump Either | 2L, 2R | M3 | Equal |
| 3 | Jump Left | 2L, 2R | M1 | Equal |
| 4 | Jump Either | 3L, 1R | M2 | Left Side |
| 5 | Jump Right | 2L, 1R | M0 | Left Side |
| 6 | Jump Left | 1L, 3R | M0 | Right Side |

For exemplary purposes it will be assumed that the outermost numerical indicator 73 on actuator 69 which is aligned with the positional indicator 77 is the number "5". With continued reference to FIG. 5 and the above-referenced table, a player may place the disc 26 on the game board 12 and align a sector line 100 such as the fifth sector line 104 with the alignment indicator 102 on the game board 12 to match the outermost numerical indicator 73 on the actuator 69. When the disc 26 is aligned in this manner, referring now to the table, there is a path line 48 matched to the right jump line 45 allowing a player to jump to the adjacent disc on the right side. There are also two disc path lines matched up with fixed lines on the left side of the disc as indicated at 106 and 108 and one disc path line 48 matched up on the right side of the disc with a fixed line as indicated at 110. There are no disc path lines that match up with central fixed path lines. The sector lines 100 are not lines along which the player can move and only serve as a positional reference point when initially positioning the discs 26 on the game board. Due to the greater number of matching lines on the left side of the disc, there is a greater chance of moving off the disc from the left side onto a fixed path with the disc in this orientation. It will be appreciated that the use of the sector lines 100 and alignment indicator 102 provide a player with a relatively simple method for initially placing the removable discs 26 on the game board. A similar procedure may be used for any remaining discs.

Various departures from the previously described embodiments will not detract from the spirit of the present invention. For example, it will also be appreciated that the gears may be independent of one another or arranged so only particular gears move when an actuator is moved. Other gear ratios may also be incorporated to create rotations of varying degrees between the discs 26.

The game pieces illustrated herein are merely exemplary and are not meant to be limiting in any manner. For example, magnetic materials could be incorporated to releasably retain the game pieces to the playing surface.

In the preferred embodiment, up to eight individual players may play the game 10 although it will be appreciated that teams may be formed so that player's alternate taking turns for their team allowing a greater number to play. For purposes of clarity in the illustrations, not all path lines 48 and game piece positions 30 are shown and it will be appreciated that alternative board layouts incorporating different numbers of path lines and game piece positions and locations of same will not detract from the spirit and scope of the present invention. The game piece positions 30 are spaced unevenly throughout the board although this is not critical to the invention and alternative spacing including equidistant spacing may be incorporated. It will further be appreciated that any number of starting and finishing positions, game pieces, routes, and variable path generators may be incorporated into the present invention without detracting from the scope and spirit of the invention and without sacrificing playability of the game.

It will be appreciated that the game 10 described herein can easily be translated into a computer generated game and that all the mechanics, displays, and rules of the game may be written in a computer program and playable over computer system or other digital platform such as a game platform.

While several forms of the present invention have been illustrated and described, it will also be apparent that various modifications may be made without departing from the spirit and scope of the invention.

What is claimed is:

1. A game board apparatus comprising:

a game board having an upper portion and a lower portion;

a playing surface covering said upper portion with a display defining a route between a plurality of starting areas and a plurality of ending areas, said route including a fixed path section and a path altering section, each of said areas and said sections including a plurality of discrete game piece positions;

a random number generator including a plurality of predetermined number designations;

a working section in said lower portion including an actuator for actuating at least one said path altering section to move said path altering section to a predetermined position based on upon a result provided by said random number generator;

a plurality of game pieces constructed to be positioned individually in one of said discrete game piece positions; and whereby players may initially position their respective said game pieces in said discrete positions in their respective said starting areas by taking turns move selected said game pieces along said fixed and path altering sections from their respective said starting area to their respective said finishing area while altering the disposition of said path altering sections by actuating said actuator to a predetermined position dependent upon an outcome of said random number generator.

2. The game board apparatus as set forth in claim 1 wherein said actuator is at least one rotatable gear having number designations matching said predetermined number designations of said random number generator.

3. The game board apparatus as set forth in claim 1 wherein:

said random number generator is a six sided die.

4. The game board apparatus as set forth in claim 1 wherein:

said path altering section includes at least one rotating disc.

5. The game board apparatus as set forth in claim 4 wherein:

said working section includes at least one gear intermeshed with said actuator and underlying said rotating disc and constructed to turn said disc upon movement of said actuator.

6. The game board apparatus as set forth in claim 1 further including:

a gear trench system recessed into said working section and having a plurality of interconnected gears in said trench system with a least one gear intermeshed with said actuator, at least one gear being connected to a rotating disc overlaid with a path altering section.

7. The game board apparatus as set forth in claim 1 wherein:

said number of starting areas and finishing areas is an even number.

8. The game board apparatus as set forth in claim 7 wherein: said even number is eight.

9. The game board apparatus as set forth in claim 1 wherein: each player has seven game pieces to move across said game board.

10. The game board apparatus as set forth in claim 1 wherein: said path altering section includes four rotating discs.

11. The game board apparatus as set forth in claim 10 wherein: each of said rotating discs turns clockwise upon rotation of said actuator.

12. The game board apparatus as set forth in claim 10 wherein: each of said rotating discs turns counterclockwise upon rotation of said actuator.

13. The game board apparatus as set forth in claim 10 wherein: at least one of said discs turns clockwise and at least one of said other discs turns counterclockwise upon rotation of said actuator.

14. The game board apparatus as set forth in claim 1 wherein: said starting areas and said finishing areas are connected by more than one route.

15. The game board apparatus as set forth in claim 1 wherein:

said starting and finishing areas are positioned marginally around said fixed and path altering sections.

16. Game board apparatus as set forth in claim 1 wherein:

said playing surface includes a plurality of holding positions for entering said path altering section.

17. Game board apparatus as set forth in claim 1 wherein:

said playing surface includes blocking positions between said fixed path sections and said path altering sections.

18. A game board apparatus comprising:

a game board including a playing surface having a number of starting areas and an equal number of finishing areas, said playing surface further including a game piece positioning network connecting said starting and finishing areas and having a fixed path section and a path altering section formed of interconnected rotating discs having an initial orientation;

a random number generator having a predetermined number of indicia;

a working section underlying said playing surface and including at least one actuator connected to at least one of said rotating discs for altering said orientation of said discs based upon one of said indicia provided by said random number generator; and a plurality of game pieces for each player constructed to be positioned in said game piece positioning network and moved along said fixed and path altering sections from a starting position to a finishing position.

19. A method for playing a game of strategy and chance comprising the steps of:

providing a game board including a playing surface having a plurality of starting and finishing areas connected by a game piece positioning network including a fixed path section and a path altering section having discrete game piece positions, said path altering section constructed to be placed in alternate orientations, said game board further including a working section underlying said playing surface and including an actuator having a number of predetermined positions and connected to said path altering section for altering said orientation of said path altering section;

providing a random number generator having a number of indicia corresponding to said actuator predetermined positions;

providing at least two sets of game pieces;

positioning each set of game pieces in a starting area;

determining the order of play;

initiating said random number generator to determine a particular indicia;

actuating said actuator to a predetermined position corresponding to said indicia to alter said orientation of said path altering section;

moving a game piece from one game piece position to another; and repeating said initiating, actuating, and moving steps between players as necessary for one player to move all respective said game pieces to a respective said finishing area.

20. The method for playing a game as set forth in claim 19 wherein:

said moving step may include jumping one game piece over an adjacent game piece to an open game piece position.

* * * * *

UNITED STATES PATENT AND TRADEMARK OFFICE

CERTIFICATE OF CORRECTION

PATENT NO. : 6,361,048 B1
DATED : March 26, 2002
INVENTOR(S) : James Lynn

It is certified that error appears in the above-identified patent and that said Letters Patent is hereby corrected as shown below:

Title page,
Item [57], ABSTRACT,
Line 8, replace “determined” with -- predetermined --.

Signed and Sealed this

Eighteenth Day of June, 2002

*Attest:*

*Attesting Officer*

JAMES E. ROGAN
*Director of the United States Patent and Trademark Office*